United States Patent [19]

Ostrowsky

[11] 4,414,705

[45] Nov. 15, 1983

[54] OVERCENTER HINGE

[75] Inventor: Efrem M. Ostrowsky, Highland Park, Ill.

[73] Assignee: Ethyl Products Company, Richmond, Va.

[21] Appl. No.: 284,489

[22] Filed: Jul. 17, 1981

[51] Int. Cl.[3] ..... E05D 1/02; B65D 51/04

[52] U.S. Cl. ..... 16/225; 215/224; 220/339

[58] Field of Search ..... 16/225; 215/216, 224, 215/235; 24/137 R, 137 A, 252 R, 252 A, 252 B; 220/337, 339, 335

[56] References Cited

U.S. PATENT DOCUMENTS

| | | | |
|---|---|---|---|
| 2,894,654 | 7/1959 | Lohrer | 215/235 |
| 3,289,877 | 12/1966 | Wolf . | |
| 3,596,822 | 8/1971 | Holley | 220/339 X |
| 3,623,622 | 11/1971 | Sullivan | 215/216 X |
| 3,628,215 | 12/1971 | Everberg | 16/225 |
| 3,629,901 | 12/1971 | Wolf | 220/339 X |
| 3,720,979 | 3/1973 | Krawagna | 24/252 |
| 3,741,447 | 6/1973 | Miles et al. | 222/517 |
| 3,933,271 | 1/1976 | McGhie | 222/517 X |
| 4,047,495 | 9/1977 | O'Brian | 215/224 |
| 4,089,467 | 5/1978 | Makowicki | 16/225 X |
| 4,236,274 | 12/1980 | Omote et al. | 16/225 |
| 4,344,545 | 8/1982 | Aschberger et al. | 215/235 X |

FOREIGN PATENT DOCUMENTS 930934 7/1963 United Kingdom .

*Primary Examiner*—E. R. Karenske
*Assistant Examiner*—John S. Brown
*Attorney, Agent, or Firm*—Donald L. Johnson; John F. Sieberth; Edgar E. Spielman, Jr.

[57] ABSTRACT

An integral thermoplastic biasing hinge is disclosed. Hinged plate members are biased to achieve one of two positions, e.g., an open or closed position by the utilization of a spring member having two arms which are resiliently connected at one of their ends and hingedly connected to the plate members at their other ends.

10 Claims, 6 Drawing Figures

OVERCENTER HINGE

BACKGROUND OF THE INVENTION

This invention relates to a thermoplastic biased hinge in which the hinge tends to hold itself in a closed position and/or an open position. Such hinges have found acceptance in the market place and are used as part of thermoplastic closures for the packaging of consumer products such as hand lotions, toothpaste, etc.

Exemplary of prior art biased hinges are the ones disclosed in U.S. Pat. Nos. 3,289,877; 3,628,215; 3,629,901; 3,720,979; 4,047,495 and British Specification No. 930,934.

It is an object of this invention to provide a simplified thermoplastic hinge which provides an open and/or close bias.

THE INVENTION

This invention relates to a thermoplastic integrally formed biasing hinge suitable for use in biasing hinged plate members in either the open or closed position. Generally, the plate members are also of thermoplastic material and integrally formed together along with the biased hinge. Hinging of the plate members, one to the other, is accomplished by utilization of a thin, flexible hinge line. This hinge line is not biased and provides a point of rotation for the plate members so that they are in mating cooperation when the members are in the closed position. The biasing spring comprises a first spring arm and a second spring arm resiliently connected, one to the other, at one of their ends. The first spring arm, at its other end, is hingedly connected to one of the plate members, while the second arm has its other end hingedly connected to the other plate member. The connection of the first spring arm to its respective plate member forms a second hinge line, while a third hinge line is formed by the connection of the second spring arm to its respective plate member. The third hinge line is upwardly offset from the first hinge line. When the closure is in the open or closed position, the second hinge line and the third hinge line are at their greatest distance from one another with the resilient connection of the spring arms being "at rest". However, as the plate members are moved from the open or closed position to the closed or open position, the second and third hinge lines are brought closer and closer together. This places the biasing spring member in resilient compression so that the plates are urged to either the open position or the closed position depending upon the position of the second hinge line with respect to the first hinge line. As the plate members are rotated about the first hinge line to move them from the open position to the closed position, the second hinge line will move from a location outside of the first hinge line to a point over the first hinge line and then to a location inside the first hinge line. Discontinuance of the rotation of the plate members while the second hinge line is outside of the first hinge line will result in the plate members being biased to return to the original open position. However, once the second hinge line is inside the first hinge line the plates are biased to the closed position. When moving the plates from the closed position to the open position, the same action is realized; i.e., the inside location of the second hinge lines urges the plates to the closed position and the outside location of the second hinge line urges the plates to the open position.

It is preferred that the material of which the biasing spring of this invention is made be one that is capable of withstanding many flexures but which still can provide the necessary resiliency required of the spring member. Exemplary of suitable materials are polypropylene, high density polyethylene, acetals, butadiene styrene polymers and the like. Conventional injection molding techniques may be utilized in forming the biasing spring of this invention.

These and other features attributing satisfaction in use and economy of manufacture will be more fully understood when taken in connection with the description of a preferred embodiment of this invention and the accompanying drawings in which identical numerals refer to identical parts and in which.

Figure 1:
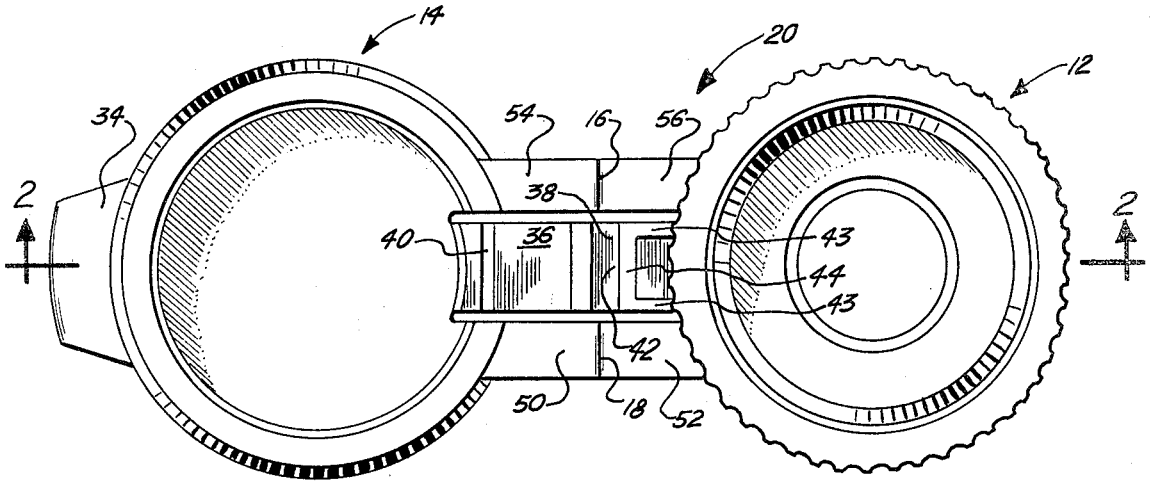
FIG. 1 is a bottom plan view of a biasing hinge of this invention used in conjunction with a two-piece closure.
Figure 2:
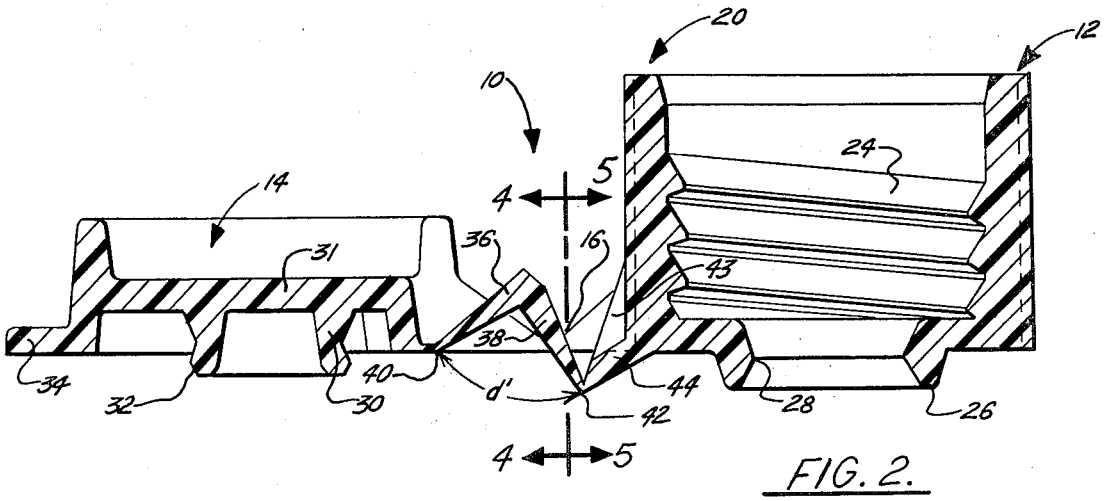
FIG. 2 is a sectional view taken through section line 2—2 in FIG. 1.
Figure 3:
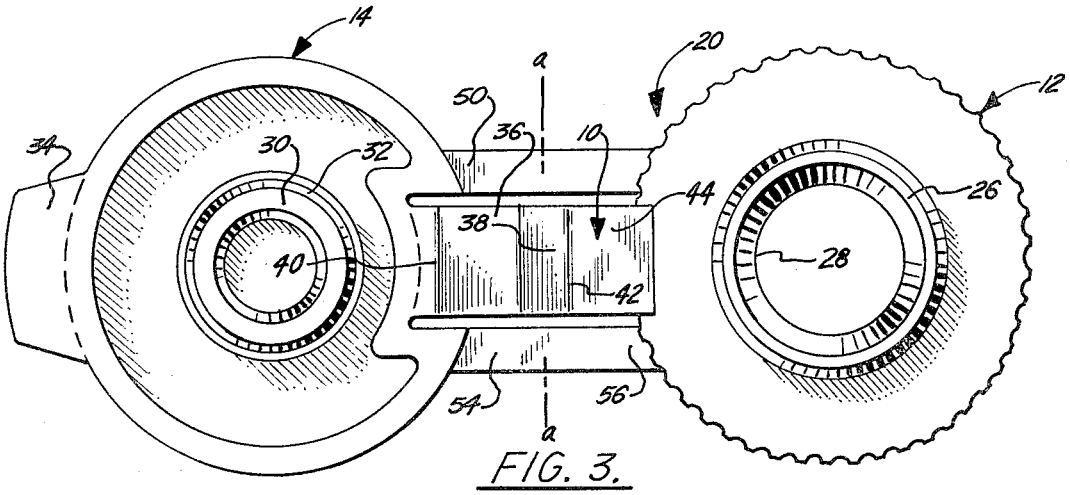
FIG. 3 is a top plan view of the biasing hinge and two-piece closure shown in FIG. 1.

Referring now to FIGS. 1–3, it can be seen that the biasing spring of this invention, generally designated by the numeral 10, is utilized in conjunction with a two-piece closure, generally designated by the numeral 20. As is shown in the drawings, biasing spring 10 and two-piece closure 20 are integrally formed.

The two-piece closure 20 comprises a closure base, generally designated by the numeral 12, and a closure top, generally designated by the numeral 14. The closure base 12 will act as one plate member with respect to biasing spring 10 while closure top 14 will act as the second plate member. It is also to be understood that the particular configuration of the closure base and closure top is not critical to the biasing spring of this invention, any configuration not interfering with the action of biasing spring 10 being acceptable.

Closure base 12 has a hollow, cylindrical shape. Carried on the inside wall of closure base 12 is a helical thread 24. Helical thread 24 is dimensioned for threaded cooperation with a container thread for achieving fitment of two-piece closure 20 to a container. Two-piece closure 20 also has a closure mouth 26 through which contents from the container can be dispensed. Displaced inwardly of closure mouth 26 is mouth latching bead 28. Latching bead 28 achieves latching cooperation with latching boss bead 32 carried by closure top 14 as hereinafter described.

Extending outwardly from closure base 12 are spaced-apart hinge straps 52 and 56. Complementary hinge straps 50 and 54 extend from closure top 14. Hinge strap 52 meets hinge strap 50 at a point where the hinge straps are thinned down to form a flexible hinge 18. Hinge straps 54 and 56 likewise meet at a thinned down portion to form hinge 16. Hinges 18 and 16 form hinge line a-a. Rotation of closure top 14 from the open or closed position to the closed or open position occurs with hinge line a-a being the pivot point or point of rotation.

Closure top 14 is circular in shape and has a top wall 31. Depending upwardly from top wall 31 (when top closure 14 is in the open position and viewed in the upright position), there is provided annular laching boss 30. Annular latching boss carries at its distal end latching boss bead 32. Upon closure of closure top 14 onto closure base 12, latching boss bead 32 will snap fit under mouth latching bead 28. This type of fit gives resistance to inadvertent opening of closure top 14. To aid in unlatching the latch formed by latching boss bead 32 and mouth latching bead 28, there is provided finger tab 34 on closure top 14.

In the space between hinge straps 50 and 54 and 52 and 56, there is hingedly positioned biasing spring 10. As can be seen in FIGS. 2 and 4–6, biasing spring 10 is hingedly attached to closure top 14 at second hinge line 40. Biasing spring 10 is also hingedly attached to closure base 12 at 42 to form a third hinge line. Viewing closure 20 in the upright position, third hinge line 42 is at a position longitudinally upwardly displaced from hinge line a-a by way of rigid post 44. (In the drawings, FIGS. 2 and 4, closure 20 is shown in the inverted position and therefore, "the upwardly displaced" position of third hinge line 42 would be described, with respect to an observer, to be "downwardly displaced" from hinge line a—a.) This longitudinal displacement of third hinge line 42 from hinge line a-a results in second hinge line 40 and third hinge line 42 being moved towards one another to compress biasing hinge 10 as closure top 14 is moved from an open position to a closed position or vice versa. To aid in maintaining rigidity in rigid post 44, there are provided gussets 43.

Biasing spring 10, as can be seen in FIG. 2, has a V-shaped configuration when viewed in cross-section. First spring arm 36 and second spring arm 38 are resiliently joined together at their thickest parts. Such a connection provides the resilient resistance against forces acting to bring the other end of spring arms 36 and 38 together. It can also be seen in FIGS. 2 and 4–6 that spring arm 36 and spring arm 38 are tapered and have thinned portions at their terminal ends. Spring arm 36 is attached at its thinned end to closure top 14 to form flexible second hinge 40. Second spring arm 38 is likewise attached at its thinned end with rigid post 44 to form third hinge 42.

Figure 4:
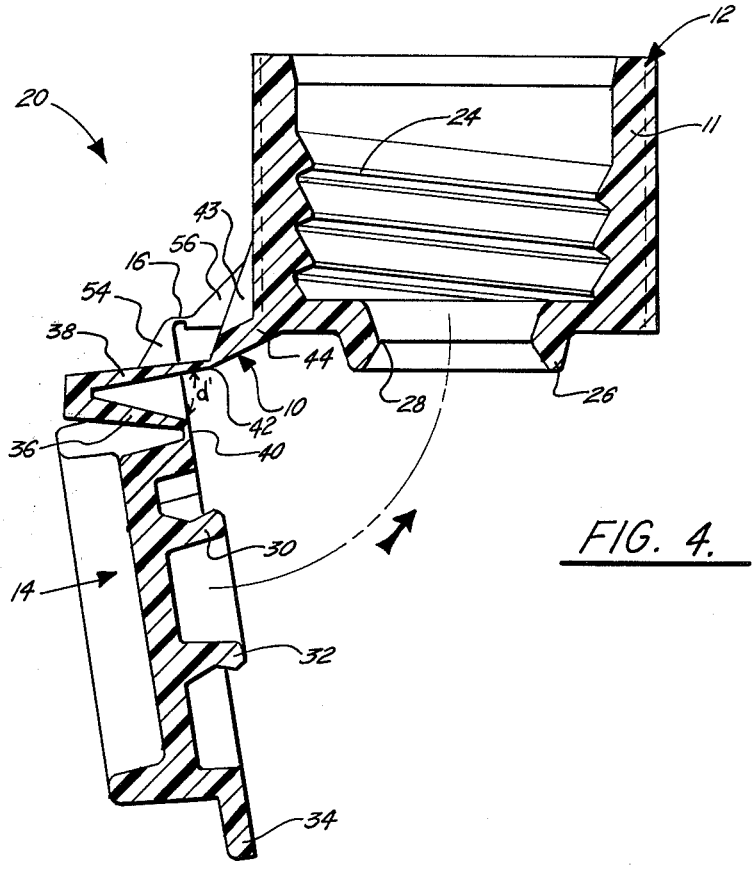
FIG. 4 is the sectional view shown in FIG. 2 with the closure being rotated towards the closed position.
Figure 5:
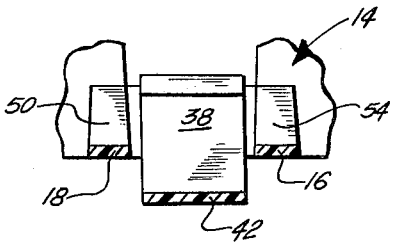
FIG. 5 is a sectional view taken through section line 5—5 in FIG. 2.
Figure 6:
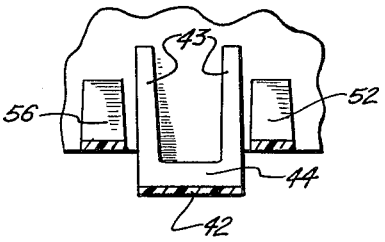
FIG. 6 is a sectional view taken through section line 6—6 in FIG. 2.

As can be seen in FIGS. 2 and 4, two-piece closure 20 is, in FIG. 2 in the open position and, in FIG. 4, in a position moving toward the closed position. In FIG. 2, second hinge line 40 is a distance D from third hinge line 42, and there is no compression of biasing spring 10. As rotation of closure top 14 about hinge line a—a is performed, this distance decreases, shown as D′ in FIG. 4 thereby compressing biasing spring 10. In FIG. 4, second hinge line 40 is located on the inside of first hinge line a—a resulting in the biasing of closure top 14 to assure the closed position with respect to closure base 12. Moving closure top 14 from the closed position to the open position results in, when second hinge line 40 is outside of first hinge line a—a, biasing of closure top 14 to the open position.

What is claimed:

1. A thermoplastic biasing spring integrally formed with first and second plate members, said plate members being hingedly connected one to the other along a first hinge line, said plate members being pivotably moveable about said first hinge line from a first position to a second position, and said second plate member having a rigid post longitudinally displaced from said first hinge line, said biasing spring comprising: a first arm and a second arm resiliently connected at one of their ends and said first arm being hingedly connected at its other end to said first plate member to form a second hinge line and said second arm being hingedly connected at its other end to the furtherest extent of said rigid post to form a third hinge line, said third hinge line being longitudinally displaced from said first hinge line whereby pivoting movement of one or both of said plate members about said first hinge line from one of said positions to the other said positions causes said second hinge line to move closer to said third hinge line thereby placing said biasing spring in compression, said compression urging said plate members to one of said positions dependent upon the location of said second hinge line with respect to said first hinge line as said plate members accomplish said pivoting movement.

2. The biasing spring of claim 1 wherein said biasing spring is V-shaped.

3. The biasing spring of claim 2 wherein said biasing spring is of non-uniform cross-section.

4. The biasing spring of claim 1 wherein said biasing spring is made of polyethylene terephthalate.

5. The biasing hinge of claim 3 wherein said biasing spring is made of polypropylene.

6. The biasing spring of claim 1 wherein said first plate is a closure base fitable to a container and having an aperture therethrough for the dispensing of the contents of said container and said second plate is a closure top capable of sealing off said aperture when said closure top is in one of said positions.

7. the biasing spring of claim 6 wherein said biasing spring is V-shaped.

8. The biasing spring member of claim 7 wherein said biasing spring is made of polypropylene.

9. The biasing spring of claim 7 wherein said biasing spring is made of polyethylene terephthalate.

10. The biasing spring of claim 7 wherein said biasing spring is of non-uniform cross-section.

* * * * *

UNITED STATES PATENT AND TRADEMARK OFFICE

CERTIFICATE OF CORRECTION

PATENT NO. : 4,414,705

DATED : November 15, 1983

INVENTOR(S) : EFREM M. OSTROWSKY

It is certified that error appears in the above-identified patent and that said Letters Patent is hereby corrected as shown below:

In the Abstract

Line 1, "biasing hinge" should read -- spring member --.

Column 3, line 26, "hinge" should read -- spring --.

Column 4, line 37, "hinge" should read -- spring --.

Column 4, line 45, "the" should read -- The --.

Column 4, line 47, "spring member" should read -- spring --.

Signed and Sealed this

*Third* Day of *April 1984*

[SEAL]

*Attest:*

GERALD J. MOSSINGHOFF

*Attesting Officer*

*Commissioner of Patents and Trademarks*